US005823331A

United States Patent [19]

Manservigi et al.

[11] Patent Number: 5,823,331

[45] **Date of Patent: *Oct. 20, 1998**

[54] RIGID HINGED-LID PACKET

[75] Inventors: Alberto Manservigi, Bologna; Fiorenzo Draghetti, Medicina, both of Italy

[73] Assignee: G.D. Societa'per Azioni, Bologna, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 710,971

[22] Filed: Sep. 24, 1996

[30] Foreign Application Priority Data

Sep. 25, 1995 [IT] Italy ..... B095A0446

[51] Int. Cl.[6] ..... B65D 85/10

[52] U.S. Cl. ..... 203/268; 206/271

[58] Field of Search ..... 206/242, 259, 206/261, 265, 268, 271, 273

[56] References Cited

U.S. PATENT DOCUMENTS

| | | | |
|---|---|---|---|
| 5,044,550 | 9/1991 | Lamm | 206/268 X |
| 5,207,322 | 5/1993 | Focke | 206/268 |
| 5,487,468 | 1/1996 | Sheahan | 206/242 |

FOREIGN PATENT DOCUMENTS

| | | |
|---|---|---|
| 429607 | 9/1938 | Belgium . |
| 0 650 907 A1 | 5/1995 | European Pat. Off. . |
| 36 15 828 A1 | 11/1987 | Germany . |

*Primary Examiner*—Jacob K. Ackun

*Attorney, Agent, or Firm*—Marshall, O'Toole, Gerstein, Murray & Borun

[57] ABSTRACT

A rigid packet with a hinged lid for cigarettes, the packet being defined by a cup-shaped container, and by a cup-shaped lid hinged to an open top end of the container so as to rotate between an open and closed position respectively opening and closing the container; the packet presenting a front wall, and two lateral walls connected to the front wall by two connecting walls presenting a curved cross section with a radius of curvature equal to about 1.5 times the radius of curvature of a normal cigarette.

11 Claims, 4 Drawing Sheets

*Fig.* 1

11
2
6
10
1
8
8
62
62
63
61
8'
6'
45
7
8'
36
11'
46
37
57
9'
10'
57
52
52
38
55
55
7'
43
44
50
59
59
54
54
50
39,28
51
51
60
60
13'
56
56
15'
53
53
58
40
41
58
14'
14'
47
48
64
65
17'
16'
49a
42
49
12'
49a

RIGID HINGED-LID PACKET

BACKGROUND OF THE INVENTION

The present invention relates to a rigid hinged-lid packet.

The present invention is particularly advantageous for producing packets of cigarettes, to which the following description refers purely by way of example.

Rigid hinged-lid packets of cigarettes are normally in the form of a rectangular parallelepipedon with sharp edges, which not only result in damage to clothing material coming into contact with the packet, but normally also require stabilizing from the inside by arranging the cigarettes inside the packet in such a way as to compensate for the lesser rigidity of the front of the packet as compared with the rear. Such an arrangement normally consists in arranging the cigarettes in three layers, the front one of which always contains the maximum possible number of cigarettes to strengthen the front wall of the packet as far as possible.

Such an arrangement, however, involves several drawbacks, by virtue of the front layer of cigarettes occupying all the space between the smaller lateral walls of the packet and so preventing smooth opening of the lid when the packet is opened for the first time.

SUMMARY OF THE INVENTION

It is an object of the present invention to provide a rigid hinged-lid packet for cigarettes, designed to overcome the aforementioned drawbacks.

It is a further object of the present invention to provide a rigid hinged-lid packet, which may be produced from a smaller amount of paper than that required for producing a corresponding parallelepiped packet.

According to the present invention, there is provided a rigid hinged-lid packet comprising a cup-shaped bottom container, and a cup-shaped lid hinged to an open top end of the container so as to rotate between an open position and a closed position; the packet being substantially in the form of a rectangular parallelepipedon, and comprising a front wall, a rear wall, and two lateral walls; the packet being characterized in that the front wall presents a smaller surface than the rear wall; and in that the packet comprises two connecting walls for connecting the front wall to the lateral walls; said connecting walls presenting a curved cross section.

Preferably, said connecting walls present a radius of curvature equal to one and half times the radius of a said cigarette.

BRIEF DESCRIPTION OF THE DRAWINGS

A number of non-limiting embodiments of the present invention will be described by way of example with reference to the accompanying drawings, in which:

FIG. 5 shows a section of a second embodiment of the packet according to the present invention;

DETAILED DESCRIPTION OF THE INVENTION

Figure 1:
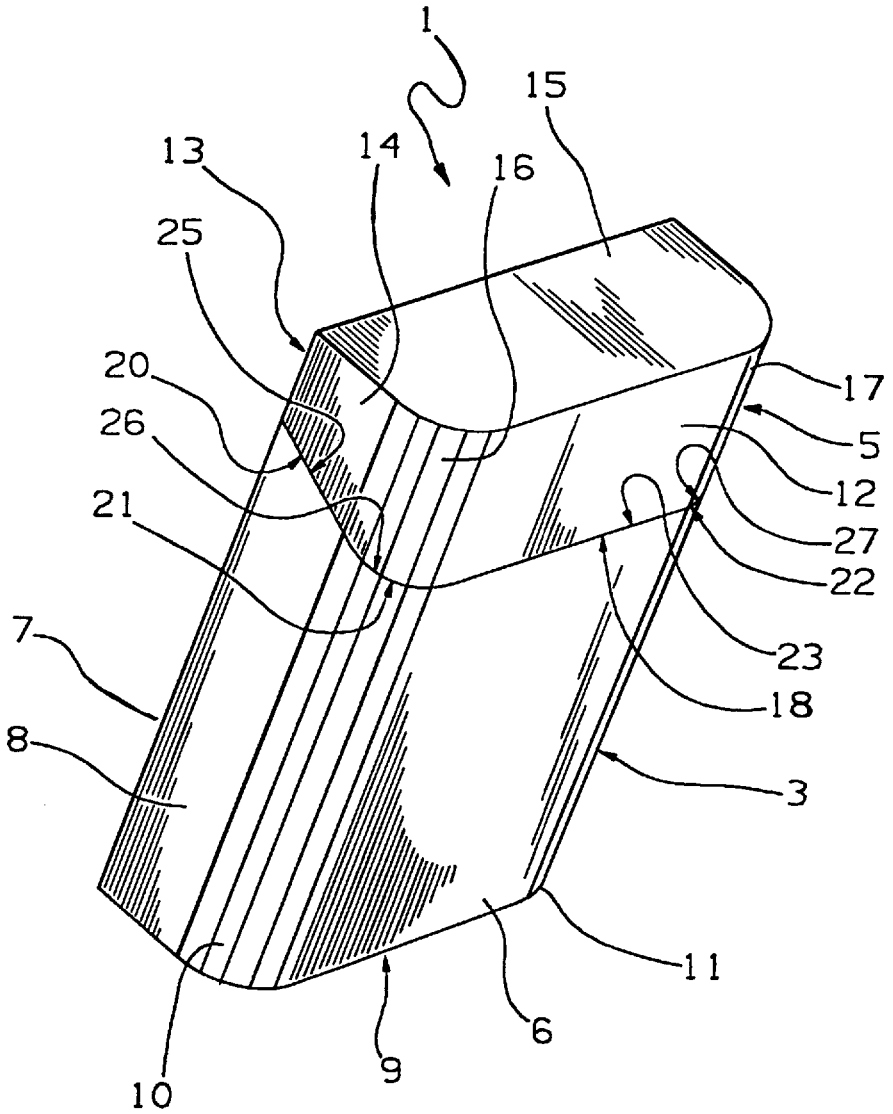
FIG. 1 shows a view in perspective of a first embodiment of the packet according to the present invention and in the closed position.
Figure 2:
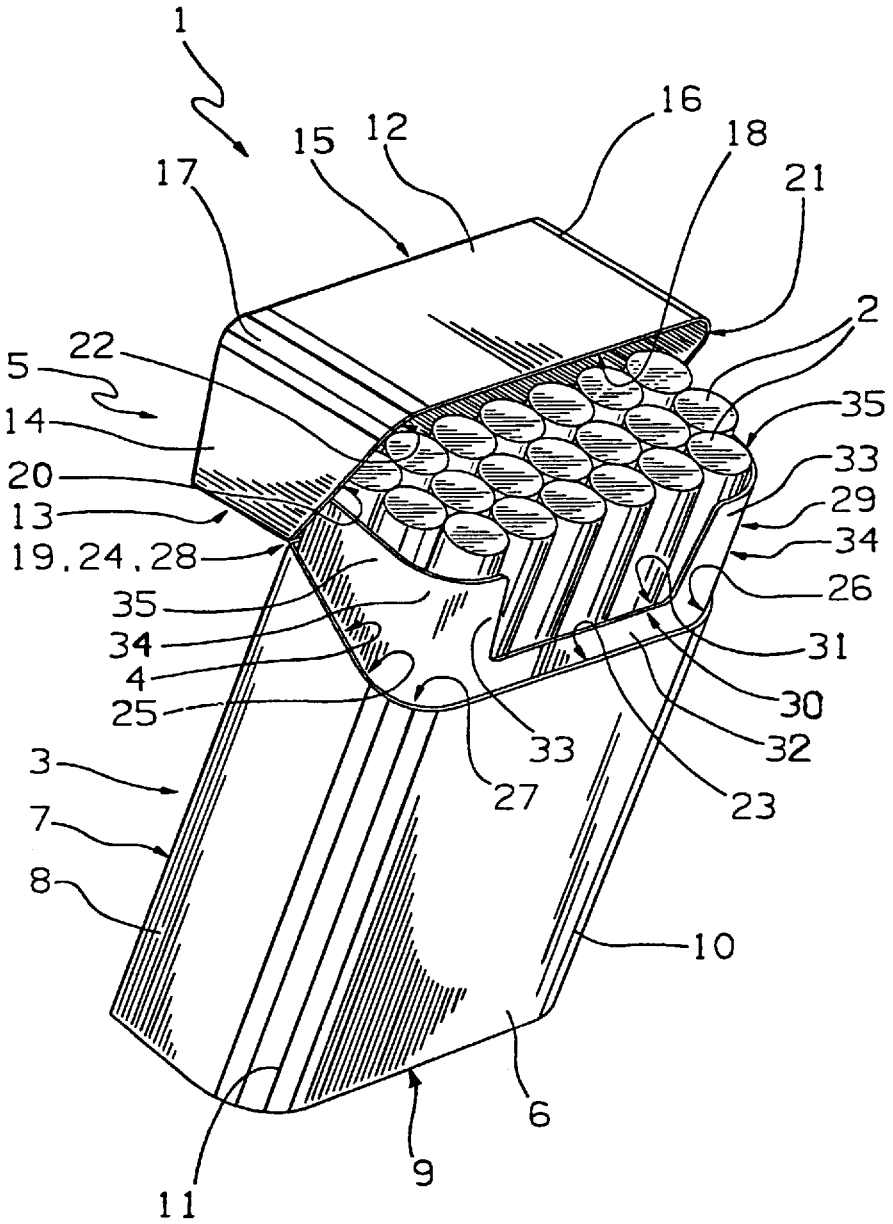
FIG. 2 shows a view in perspective of the FIG. 1 packet in the open position.
Figures 3, 4:
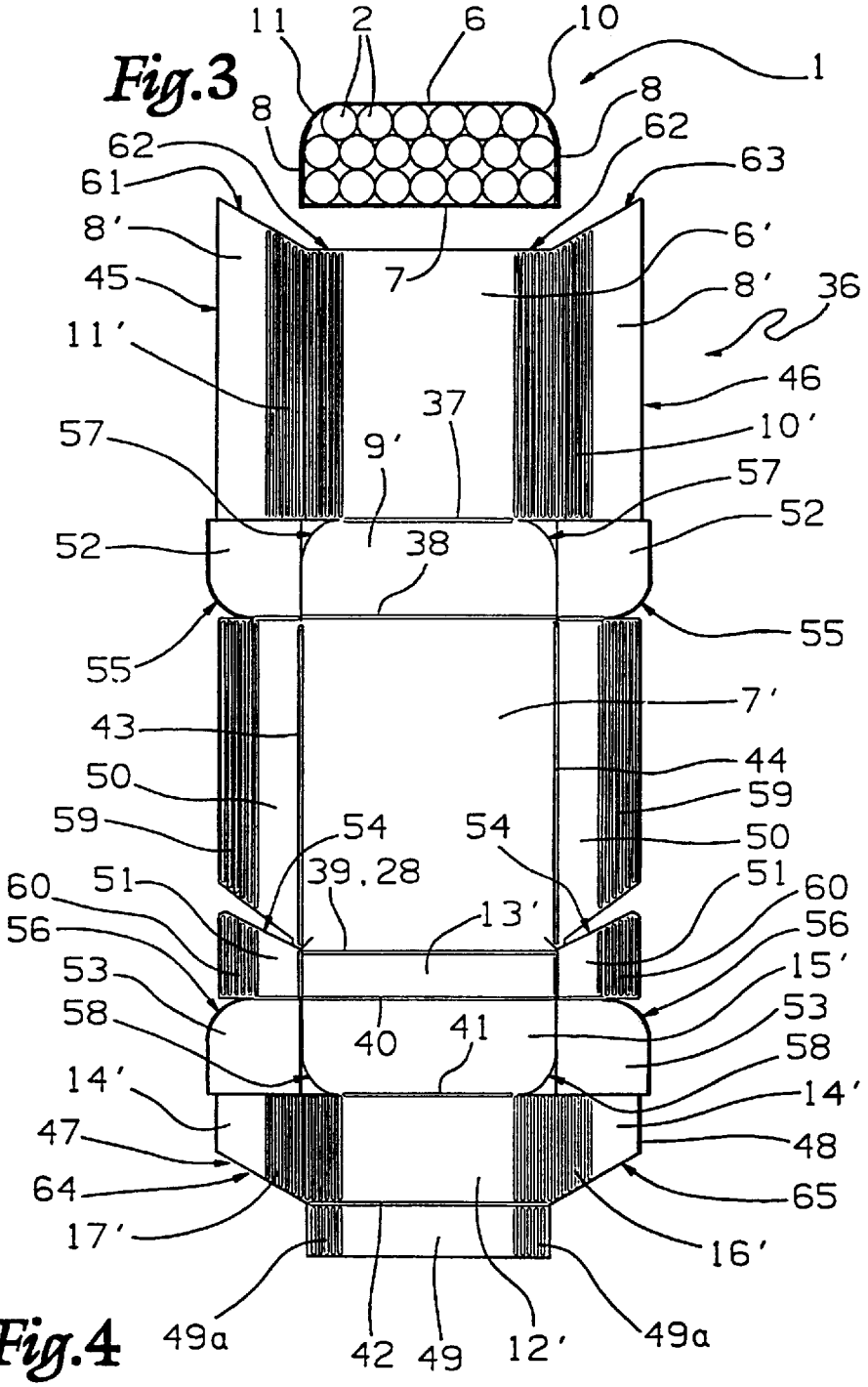
FIG. 3 shows a section of the FIG. 1 packet.
FIG. 4 shows a spreadout view of a blank from which to form the FIG. 1 packet.

Number 1 in FIGS. 1, 2 and 3 indicates a rigid packet for housing a group of cigarettes 2 arranged in at least two layers (three layers in the example shown), and of which the front outer layer presents one cigarette 2 fewer than the other two layers. Packet 1 comprises a cup-shaped bottom container 3 with an open top end 4; and a cup-shaped top lid 5 hinged to container 3 so as to rotate between an open and closed position respectively opening and closing end 4.

Container 3 presents a front wall 6 and a rear wall 7 parallel to and facing each other; two lateral walls 8 parallel to each other and perpendicular to walls 6 and 7; a bottom wall 9 perpendicular to walls 6, 7 and 8; and a further two substantially cylindrical walls 10 and 11 perpendicular to wall 9 and connecting front wall 6 to respective lateral walls 8. More specifically, walls 10 and 11 present a substantially curved cross section with a radius of curvature equal to one and a half times the radius of a cigarette 2.

Lid 5 presents a front wall 12 and a rear wall 13 parallel to and facing each other; two lateral walls 14 parallel to each other and perpendicular to walls 12 and 13; a top wall 15 perpendicular to walls 12, 13 and 14; and a further two cylindrical walls 16 and 17 perpendicular to wall 15, connecting front wall 12 to respective lateral walls 14, and presenting a substantially curved cross section with a radius of curvature equal to one and a half times the radius of a cigarette 2. Walls 12, 13, 14, 16 and 17 present respective free edges 18, 19, 20, 21 and 22 respectively facing the respective free edges 23, 24, 25, 26 and 27 of walls 6, 7, 8, 10 and 11; and edge 24 is integral with edge 19 with which it defines a hinge 28 by which to rotate lid 5 between said open and closed positions.

Packet 1 also comprises a U-shaped collar 29 projecting partly outwards of end 4, and in turn comprising a central wall 30 with a central cavity 31 facing lid 5 and defining, on wall 30, a sunken central portion 32, and two lateral wings 33 extending towards lid 5. Wall 30 is made integral with the inner surface of wall 6, from which part of central portion 32 and part of wings 33 project, and is connected to two cylindrical connecting walls 34 integral with the inner surface of respective walls 10, 11, and presenting substantially the same curved cross section as walls 10 and 11. Cylindrical walls 34 are connected to respective lateral walls 35 integral with the inner surface of respective walls 8, and connect respective lateral walls 35 to central wall 30; and walls 34 and 35 project partly towards lid 5.

As shown in FIG. 4, packet 1 is formed, by way of example, from a flat, substantially elongated rectangular blank 36, the component parts of which are indicated, wherever possible, using the same reference numbers, plus a (′), as for the corresponding parts of packet 1.

As shown in FIG. 4, blank 36 is substantially in the form of an elongated rectangle of much the same shape as a standard blank from which to form rigid hinged-lid packets, and presents a number of preformed transverse bend lines 37–42 and two preformed longitudinal bend lines 43, 44.

Between lines 43 and 44, lines 37–42 define a panel 9′ extending between lines 37 and 38; and a first end panel 6′ integral with panel 9′ along line 37, narrower than the distance between lines 43 and 44, and presenting two lateral tabs 45 and 46 defined by respective free edges aligned with line 37. Lateral tabs 45 and 46 present respective first portions 11′ and 10′ adjacent to panel 6′ and characterized by respective numbers of preformed longitudinal bend lines defining, at said respective free edges, respective edges formable into the same shape as respective walls 11 and 10; and respective second smooth outer portions indicated 8' for both lateral tabs 45 and 46.

Between lines 43 and 44, lines 37–42 also define a panel 7' extending between lines 38 and 39; a panel 13' extending between lines 39 and 40; a panel 15' of the same height as panel 9' and extending between lines 40 and 41; and an end panel 12' higher than panel 13', extending between lines 41 and 42, of the same width as panel 6', and presenting two lateral tabs 47 and 48. Lateral tabs 47 and 48 present respective first portions 17' and 16' adjacent to panel 12' and characterized by respective numbers of preformed longitudinal bend lines; and respective second smooth portions indicated 14' for both lateral tabs 47 and 48. In addition to lateral tabs 47 and 48, panel 12' is also connected, along line 42, to a strengthening tab 49 of a width equal to the distance between lines 43 and 44, and presenting two end portions 49*a*, each characterized by a number of preformed longitudinal bend lines, and each of a width equal to half the difference between the width of panel 12' and the distance between lines 43 and 44.

Each line 43, 44 defines tabs 50 and 51 outwards of respective panels 7' and 13'; each tab 50 outwards of panel 7' presents a longitudinal appendix 52 joined to respective tab 50 along line 38; each tab 51 outwards of panel 13' presents a longitudinal appendix 53 joined to respective tab 51 along line 40; and each tab 50 is detached from respective tab 51 by an oblique, substantially triangular slit 54.

In connection with the above, it should be pointed out that the width of each appendix 52 and each appendix 53 is equal to the height of panels 9' and 15'; and appendixes 52 and 53 are connected along respective lines 38 and 40 to respective tabs 50 and 51 by a length less than their own width, and present respective circular edges 55 and 56 for connection to the ends of respective lines 38 and 40. Panels 9' and 15' also present respective circular edges 57 and 58 close to respective lines 37 and 41; lines 37 and 41 are equal in width to panels 6' and 12'; and the radius of circular edges 57 and 58 is equal to the radius of circular edges 55 and 56, and is substantially equal to one and a half times the radius of a cigarette 2.

Moreover, it should be pointed out that tabs 50 and 51 present respective outer portions 59 and 60 characterized by respective numbers of preformed longitudinal bend lines as of the point at which appendixes 52 and 53 depart from respective tabs 50 and 51 and terminate with respective circular edges 55 and 56.

Finally, it should be pointed out that tab 45 extends beyond the free end of panel 6', and is defined longitudinally, at the opposite end to line 37, by an oblique edge 61 up to the extension of longitudinal line 43, and from there by an edge 62 parallel to line 37. Similarly, tab 46 extends beyond the free end of panel 6', and is defined longitudinally, at the opposite end to line 37, by an oblique edge 63 converging with the other edge 61 up to the extension of longitudinal line 44, and from there by an edge 62 parallel to line 37. Tabs 47 and 48 are defined, at the opposite end to line 41, by respective oblique edges 64 and 65 parallel to respective edges 61 and 63 and converging towards tab 49.

Line 39 defines hinge 28; tabs 50 are folded squarely in relation to panel 7', with outer portions 59 folded further inwards of panel 7'; by rotating panels 6' and 7' towards each other and squarely in relation to panel 9', tabs 50 are made integral with tabs 45 and 46, which are so folded beforehand that smooth outer portions 8' are perpendicular to panel 6' and portions 10' and 11' assume a cylindrical shape, so as to form walls 8, 10 and 11 of container 3; and appendixes 52 are folded squarely in relation to respective tabs 50, and are rotated, together with tabs 50, onto the inner surface of panel 9' with which they define wall 9. Similarly, tabs 51 are folded squarely in relation to panel 13', with outer portions 60 folded further inwards of panel 13'; by rotating tab 49 onto the inner surface of panel 12', and by rotating panels 12' and 13' towards each other and squarely in relation to panel 15', tabs 51 are made integral with tabs 47 and 48, which are so folded beforehand that smooth outer portions 14' are perpendicular to panel 12' and portions 16' and 17' assume a cylindrical shape, so as to form walls 14, 16 and 17 of lid 5; and appendixes 53 are folded squarely in relation to respective tabs 51, and are rotated, together with tabs 51, onto the inner surface of panel 15' with which they define wall 15.

It should be pointed out that, at the end of the above folding operation, circular edges 55 are superimposed on circular edges 57, face but are detached from the edges of portions 10', 11' of tabs 45, 46, and face the edges of outer portions 59 of tabs 50; similarly, circular edges 56 are superimposed on circular edges 58, face but are detached from the edges of portions 16', 17' of tabs 47, 48, and face the edges of outer portions 60 of tabs 51; and, at circular edges 55, 56, 57 and 58, packet 1 is open.

The above folding operation of blank 36 obviously only provides for forming container 3 and lid 5, so that collar 23 must be folded separately and subsequently made integral with container 3.

Figure 6:
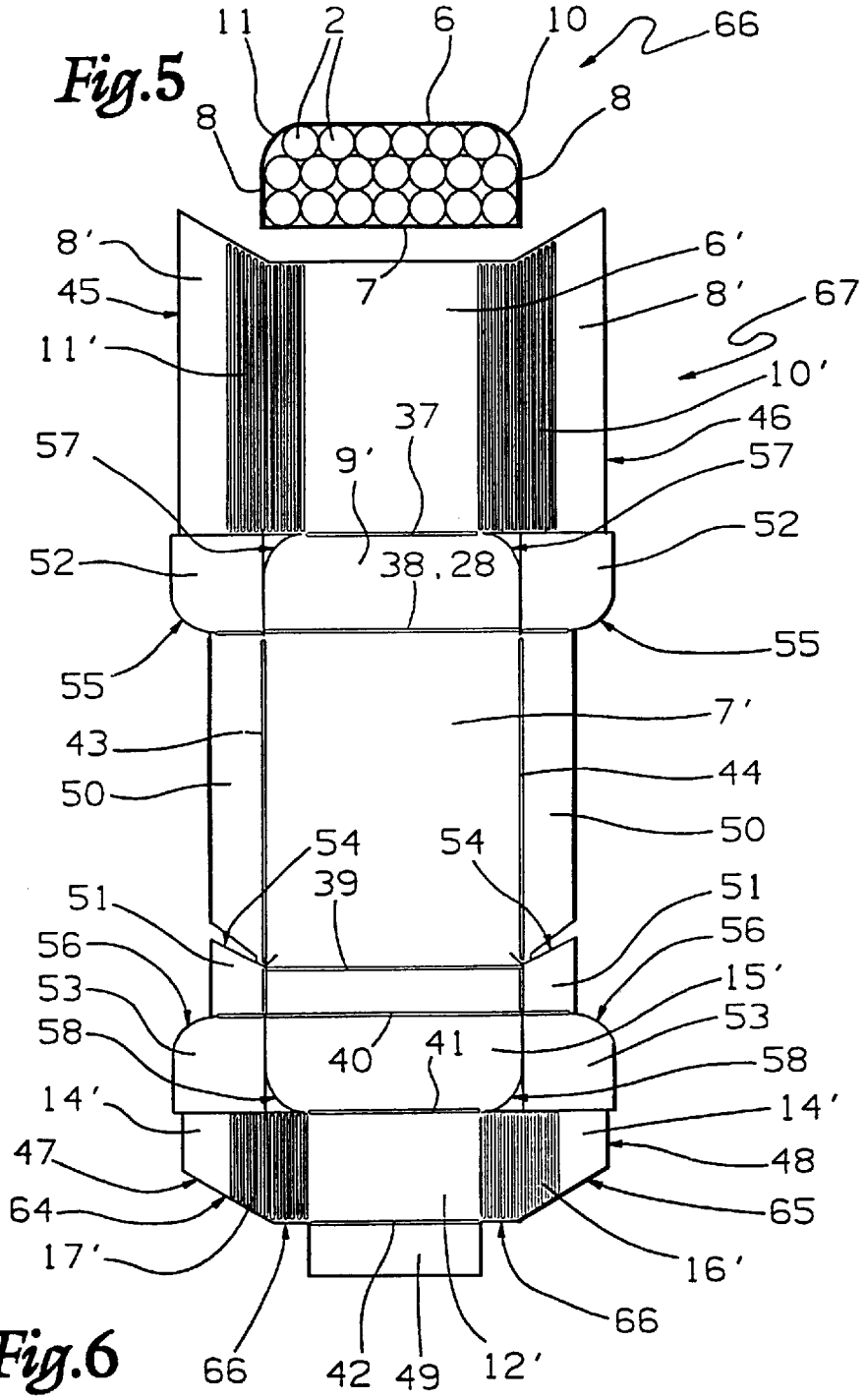
FIG. 6 shows a spreadout view of a blank from which to form the packet in the FIG. 5 section.

FIGS. 5 and 6 show a packet 66 formed from a blank 67, which are much the same as packet 1 and blank 36, and the component parts of which are indicated, wherever possible, using the same reference numbers as for the corresponding parts of packet 1 and blank 36.

As shown in FIG. 6, unlike packet 1, tabs 50 and 51 of packet 66 lack respective outer portions 59 and 60 characterized by preformed longitudinal bend lines; tabs 50 and 51 are connected along their whole width to respective appendixes 52 and 53; strengthening tab 49 presents the same width as panel 12', and lacks the ends characterized by preformed longitudinal bend lines; and lateral tabs 47 and 48 are defined by respective oblique edges 64 and 65 converging up to the extension of respective lines 43 and 44, and from there by respective edges 66 forming an extension of line 42.

We claim:

1. A rigid packet (1) with a hinged-lid (5), the packet (1) comprising a cup-shaped bottom container (3), and a cup-shaped lid (5) hinged to an open top end (4) of the container (3) so as to rotate between an open position and a closed position; the packet (1) being substantially in the form of a rectangular parallelepipedon, and comprising a front wall (6, 12), a rear wall (7, 13), and two lateral walls (8, 14); the packet (1) being characterized in that the front wall (6, 12) presents a smaller surface than the rear wall (7, 13); and in that the packet (1) comprises two connecting walls (10, 16; 11, 17) for connecting the front wall (6, 12) to the lateral walls (8, 14); said connecting walls (10, 16; 11, 17) presenting a curved cross section with a radius of curvature equal to one and a half times the radius of a normal cigarette (2).

2. A packet as claimed in claim 1, characterized by comprising a first (9) and second (15) end wall, each substantially in the form of a rectangle with two front corners defined by two rounded edges (57, 58) of the same shape as the cross section of said connecting walls (10, 16; 11, 17); said rounded edges (57, 58) extending along, but being detached from, respective end edge of the respective said connecting walls (10, 16; 11, 17).

3. A packet as claimed in claim 2, characterized by being formed from a flat, substantially rectangular blank (36; 67) presenting two preformed longitudinal bend lines (43, 44), and a number of preformed transverse bend lines (37–42) defining, between said two longitudinal bend lines (43, 44) and for both the container (3) and the lid (5), a front panel (6'; 12'), an intermediate panel (9'; 15') and a rear panel (7'; 13'); each front panel (6'; 12') presenting two opposite longitudinal front lateral tabs (45, 46; 47, 48); the rear panels (7'; 13') presenting respective pairs of opposite longitudinal rear lateral tabs (50; 51) aligned with each other and separated by respective slits (54); and the rear lateral tabs (50; 51) presenting respective longitudinal appendixes (52; 53) extending from opposite ends of the rear lateral tabs (50; 51).

4. A packet as claimed in claim 3, characterized in that each front lateral tab (45, 46; 47, 48) presents a first portion (11'; 10'; 17', 16') presenting a number of further preformed longitudinal bend lines; and a second smooth portion (8'; 14') extending outwards of the respective said first portion (11', 10'; 17', 16').

5. A packet as claimed in claim 4, characterized in that said longitudinal appendixes (52; 53) are located on either side of the respective intermediate panel (9'; 15'), and present a width equal to the height of the intermediate panel (9'; 15'); each intermediate panel (9'; 15') presenting, close to the respective transverse bend line (37; 41), a respective first rounded edge (57; 58) for connection to the ends of the respective further transverse bend line (38; 40); each longitudinal appendix (52; 53) being superimposed on the corresponding intermediate panel (9'; 15') to define a portion of a respective said end wall (9; 15) of the packet (1); and each longitudinal appendix (52; 53) also presenting, at a longitudinal end facing the respective lateral tab (50; 51), a second rounded edge (55; 56) which coincides with a respective said first rounded edge (57; 58).

6. A packet as claimed in claim 5, characterized in that said blank (36; 67) comprises a strengthening tab (49) extending from said front panel (12') along the respective transverse bend line (42); said strengthening tab (49) presenting the same width as said front panel (12').

7. A packet as claimed in claim 6, characterized in that said strengthening tab (49) presents two end portions (49*a*), each of a width equal to half the difference between the width of said front panel (12') and the distance between said longitudinal bend lines (43, 44).

8. A packet as claimed in claim 7, characterized in that each of said two end portions (49*a*) presents a number of further preformed longitudinal bend lines.

9. A packet as claimed in claim 7, characterized in that said blank (36) comprises, for each said lateral tab (50), a respective outer portion (59) presenting a number of preformed longitudinal bend lines; said outer portion (59) being superimposed on the respective said first portion (11', 10') to define a portion of a respective connecting wall (11, 10).

10. A packet as claimed in claim 6, characterized in that said blank (36) comprises, for each said lateral tab (51), a respective further outer portion (60) presenting a number of preformed longitudinal bend lines; said further outer portion (60) being superimposed on the respective said first portion (17', 16') to define a portion of a respective connecting wall (17, 16).

11. A packet as claimed in claim 1, characterized by comprising a collar (29) associated with the container (3) and in turn comprising a central wall (30) and two lateral walls (35) for engaging the lid (5) when the lid (5) is closed; the collar (29) also comprising two connecting walls (34) for connecting the central wall (30) to the lateral walls (35), and each of which presents a substantially curved cross section with a radius of curvature substantially equal to one and a half times the radius of a said cigarette (2).

* * * * *

UNITED STATES PATENT AND TRADEMARK OFFICE

CERTIFICATE OF CORRECTION

PATENT NO. : 5,823,331

DATED : October 20, 1998

INVENTOR(S) : Alberto Manservigi, et al.

It is certified that error appears in the above-identified patent and that said Letters Patent is hereby corrected as shown below:

TITLE PAGE:

[73] change "G.D. Societa' Per Azioni, Bologna, Italy" to --G.D Societa' Per Azioni, Bologna, Italy--

Signed and Sealed this

Sixteenth Day of March, 1999

*Attest:*

*Attesting Officer*

Q. TODD DICKINSON

*Acting Commissioner of Patents and Trademarks*